US006481645B1

(12) United States Patent
Taylor-McCune et al.

(10) Patent No.: US 6,481,645 B1
(45) Date of Patent: Nov. 19, 2002

(54) CONDIMENT DISPENSING NOZZLE APPARATUS AND METHOD

(75) Inventors: Christopher J. Taylor-McCune, Mission Viejo; Steven T. Jersey, Laguna Niguel, both of CA (US)

(73) Assignee: Shurflo Pump Mfg. Company, Inc., Santa Ana, CA (US)

( * ) Notice: Subject to any disclaimer, the term of this patent is extended or adjusted under 35 U.S.C. 154(b) by 0 days.

(21) Appl. No.: 09/577,411

(22) Filed: May 22, 2000

(51) Int. Cl.[7] ..... B05B 1/26; B05B 1/34; G67D 5/06; B65D 88/54

(52) U.S. Cl. ..... 239/461; 239/483; 239/487; 239/501; 222/144.5; 222/334

(58) Field of Search ..... 239/461, 463, 239/483, 486, 484, 485, 487, 489, 493, 501; 222/284, 287, 365, 108, 134, 135, 136, 144.5, 334, 341

(56) References Cited

U.S. PATENT DOCUMENTS 262,183 A * 8/1882 Hogan ..... 239/487
1,395,442 A * 11/1921 MacGregor ..... 239/487

(List continued on next page.)

OTHER PUBLICATIONS

Website pages "Welcome to the Home of Wunder–Bar Dispensing Systems"; www.wunderbar.com; May 19, 2000.
Website pages "Cornelius Online" "Pumpsmart Condiment Dispensers"; www.cornelius.com; May 19, 2000.
Product Brochure, "Hunt's Pumpable Condiments", Hunt–Wesson, Inc., 1997.
Product Brochure, "Introducing SAUCEflo Powered Condiment Dispense Systems",SHURflo Pump Manufacturing Co. (undated).

*Primary Examiner*—Lesley D. Morris
*Assistant Examiner*—Davis Hwu
(74) *Attorney, Agent, or Firm*—Michael Best & Friedrich LLP

(57) ABSTRACT

The nozzle of the present invention has an internal chamber, condiment input and discharge ports in fluid communication with the internal chamber, and an extension downstream of the condiment discharge port. Preferably, the internal chamber has a flow disrupter taking the form of a funnel-shaped end portion adjacent to the condiment discharge port. The internal chamber is preferably elongated and has a larger cross section than the spout to which the nozzle is connected to reduce condiment pressure and flow speed entering the nozzle. Condiment pressure can also be reduced in the internal chamber by other types of flow disrupters: protrusions extending from the internal chamber walls into the condiment flow and/or by an insert received within the internal chamber. At the funnel-shaped end portion, condiment flow adjacent to the internal chamber side walls is preferably diverted toward the discharge port to generate crossflow and turbulence, further reducing condiment pressure and force. The condiment discharge port is defined by one or more apertures preferably selected based upon the type of condiment dispensed to prevent drips between condiment dispenses. Preferably, the nozzle extension surrounds the condiment discharge port and is a skirt defining a discharge recess. Laterally-exiting condiment from the condiment discharge port is preferably diverted by the extension to prevent condiment splatter on the user and surroundings. The extension also hides condiment buildup and dangling condiment, partially encloses such condiment from the surrounding environment, and protects such condiment from contamination.

37 Claims, 8 Drawing Sheets

U.S. PATENT DOCUMENTS

| | | | | | |
|---|---|---|---|---|---|
| 1,667,943 | A | * | 5/1928 | Munz | 239/487 |
| 1,713,357 | A | * | 5/1929 | St. Clair | 239/501 |
| 3,726,482 | A | * | 4/1973 | Heinrichs | 239/487 |
| 3,756,233 | A | | 9/1973 | Goldowsky | |
| 3,788,353 | A | * | 1/1974 | Breunsbach | 239/417 |
| 4,154,402 | A | * | 5/1979 | Fletcher | 239/487 |
| 4,477,003 | A | | 10/1984 | Baker et al. | |
| 5,158,210 | A | | 10/1992 | Du | |
| 5,230,443 | A | | 7/1993 | Du | |
| 5,350,083 | A | | 9/1994 | Du | |
| 5,361,943 | A | | 11/1994 | Du | |
| 5,364,244 | A | | 11/1994 | Taylor-McCune et al. | |
| 5,366,117 | A | | 11/1994 | Mesenbring et al. | 222/132 |
| 5,395,046 | A | | 3/1995 | Knobbe et al. | |
| 5,429,308 | A | | 7/1995 | Brown | 239/414 |
| 5,429,681 | A | | 7/1995 | Mesenbring | |
| 5,431,343 | A | | 7/1995 | Kubiak et al. | 239/105 |
| 5,435,466 | A | | 7/1995 | Du | |
| 5,540,774 | A | | 7/1996 | Smitherman | 118/315 |
| 5,542,574 | A | | 8/1996 | Stern | 222/137 |
| 5,566,863 | A | | 10/1996 | Mesenbring et al. | 222/132 |
| 5,622,484 | A | | 4/1997 | Taylor-McCune et al. | |
| 5,624,056 | A | | 4/1997 | Martindale | 222/148 |
| 5,641,096 | A | | 6/1997 | Robbins et al. | |
| D401,477 | S | | 11/1998 | Martindale | D7/590 |
| 5,906,296 | A | | 5/1999 | Martindale et al. | 222/108 |
| 5,944,259 | A | | 8/1999 | Brown | |
| 5,947,800 | A | | 9/1999 | Fring | |
| 5,992,695 | A | | 11/1999 | Start | |
| 5,992,764 | A | | 11/1999 | Bougamont et al. | 239/459 |
| 5,996,846 | A | | 12/1999 | Martindale | 222/132 |
| 6,058,986 | A | | 5/2000 | Bethuy et al. | 141/198 |
| 6,082,587 | A | | 7/2000 | Martindale et al. | 222/108 |

* cited by examiner

CONDIMENT DISPENSING NOZZLE APPARATUS AND METHOD

FIELD OF THE INVENTION

This invention relates generally to devices and methods for dispensing fluid, and more particularly to condiment dispensing nozzles and methods of dispensing condiments through nozzles.

BACKGROUND OF THE INVENTION

Despite numerous developments in condiment dispensing technology, several problems still exist with conventional condiment dispensers. Among the most familiar to manufacturers, eating establishments, and users alike are problems related to the dispense of condiment from a spout or nozzle. Regardless of the manner in which condiment is fed to the spout or nozzle (e.g., by hand pump, by powered pump, gravity fed, and the like), the potential for condiment splattering or spitting is virtually always present in conventional systems. Condiment discharged in this manner can land on countertops, walls, equipment, and on people near the dispenser, requiring cleanup and causing user irritation.

Also, conventional condiment dispensers often permit condiment to drip from the spout or nozzle between dispenses. Spout and nozzle designs that are suitable for preventing dripping of one condiment type are often incapable of doing so for other condiment types.

Another problem with conventional condiment dispensing nozzles and spouts is the undesirable buildup or leftover condiment remaining on the nozzle or spout after dispenser use. Buildup can occur around the edges of nozzles and spouts, and presents a very undesirable appearance especially when left to dry. An amount of condiment left dangling from a spout or nozzle after a dispense is also unappealing. In addition, condiment buildup and leftover condiment hanging from a nozzle or spout invites condiment spoilage and contamination, compromising the quality of the condiment and the food upon which the condiment is served.

An issue impacting the design of condiment spouts or nozzles is the ability to clean the nozzle or spout. While nozzle and spout designs exist for controlling splatter, drip, fluid buildup, or dangling fluid in other types of dispensers (e.g., for paint, adhesive, caulk, and the like), these designs are very often impractical for use in a condiment dispenser because they are difficult or impossible to clean sufficiently for use in food-grade equipment. Specifically, such nozzles and spouts often employ internal chambers and components that cannot be accessed for cleaning or require types of cleaning and cleaning fluids that cannot be used with food-grade equipment. Condiment dispensing equipment manufacturers are therefore significantly limited in their ability to employ nozzle and spout designs capable of controlling condiment splatter, drip, condiment buildup, and dangling condiment.

In addition to the above design considerations, condiment dispensing nozzles and spouts that are durable, easy to manufacture, and inexpensive are highly desirable for obvious reasons. In light of the problems and limitations of the prior art described above, a need exists for a condiment dispensing nozzle apparatus and method that controls condiment splatter and spitting, prevents condiment dripping between dispenses, presents a solution to the problems of condiment buildup and dangling condiment, and that provides an easily cleanable, durable, inexpensive, and easy to manufacture design meeting food-grade equipment standards. Each preferred embodiment of the present invention achieves one or more of these results.

SUMMARY OF THE INVENTION

The nozzle of the present invention employs a number of features addressing the problems shared by conventional condiment dispensing nozzles. The nozzle has an internal chamber, a condiment input port and a condiment discharge port preferably in fluid communication with and located at opposite ends of the internal chamber, and an extension downstream of the condiment discharge port for shielding against lateral condiment discharge from the nozzle and for diverting such discharge toward a trajectory more aligned with the condiment discharge port. Preferably, the internal chamber has a flow disrupter that induces turbulence in the condiment flow, agitates the condiment flow, or otherwise disrupts condiment flow in the internal chamber. Such effects in the flow act to reduce fluid pressure in the internal chamber to thereby enable greater control over condiment dispense. The flow disrupter can include a funnel-shaped end portion of the internal chamber adjacent to the condiment discharge port (and more preferably defining the condiment discharge port). This funnel-shaped end portion can have flat or curved walls, and preferably connects the side walls of the internal chamber with the condiment discharge port.

The internal chamber is preferably elongated and has a constant cross section along a majority of its length, but can have a changing cross section by virtue of tapered, concave or convex side walls. To reduce condiment pressure and flow speed entering the nozzle, the internal chamber preferably has a larger cross section than the spout or condiment supply port to which the nozzle is connected. Condiment therefore enters the internal chamber via the nozzle's input port and travels through the internal chamber until it reaches the funnel-shaped end portion. At this point, the condiment flow adjacent to the side walls of the internal chamber is preferably diverted toward the discharge port (and more preferably, in a radial direction toward the center of the internal chamber at the end portion thereof). By diverting the condiment flow in this manner, crossflow is generated at the end portion of the internal chamber, thereby generating turbulence that further reduces condiment pressure and force. The preferably turbulent condiment flow is thereafter constricted as it passes into and through the condiment discharge port.

The condiment discharge port can be one aperture at the end portion of the internal chamber or can be a group of apertures in this same location. Preferably, the number and size of the apertures are selected based upon the type of condiment to be dispensed through the nozzle. By selecting the type of condiment discharge port in this manner, undesirable drips between condiment dispenses are avoided. Specifically, the viscosity of the condiment in combination with the cross-sectional shear exerted by the converging flow upon condiment at the end portion of the internal chamber exceeds the force exerted by the weight of the condiment at the discharge port. Condiment is thereby held from passing through the aperture(s) of the condiment discharge port between dispenses.

The extension of the nozzle preferably encircles or otherwise surrounds the condiment discharge port. Preferably, the extension is in the form of a skirt made of one or more walls integral with or connected to the nozzle body around the condiment discharge port. The extension defines a discharge recess of the nozzle. The discharge recess preferably has a constant cross section, but can be tapered toward or away from the condiment discharge port as desired (provided, however, that the discharge of condiment is unobstructed and that lateral discharge is properly diverted as mentioned above).

Upon exiting the condiment discharge nozzle, at least a portion of the condiment flow may exit laterally due to turbulent condiment flow, lateral force exerted upon the condiment by the upstream flow-diverting end portion walls in the internal chamber, air in the condiment, and the like. This flow is diverted by the extension to a trajectory more aligned with flow exiting straight from the condiment discharge port. In this manner, the present invention helps to prevent splattering on the user and surroundings even in the event that air exits the nozzle with the condiment.

The extension of the nozzle serves another purpose related to unsightly condiment buildup and excess condiment hanging from the condiment discharge port. In the event that such condiment remains after a dispense, the extension acts as a shroud to hide the condiment from view, to at least partially enclose the condiment from the surrounding environment, and to protect the condiment from contamination.

In other embodiments of the present invention, the flow disrupter of the internal chamber can be or also include one or more protrusions extending from the walls of the internal chamber into the condiment flow and/or an insert received within the internal chamber. These flow disrupters act to disrupt condiment flow as described above and preferably to reduce pressure in the internal chamber. With regard to protrusions extending from the internal chamber walls into the condiment flow, any number of regularly spaced, patterned, or random protrusions having any desired shape can be used, each of which preferably acts as a baffle to disrupt condiment flow and more preferably to induce turbulence in the condiment flow. These protrusions also preferably act as baffles to divert condiment flow through the internal chamber in a serpentine, random, or other circuitous path, thereby decreasing fluid pressure of the condiment prior to reaching the condiment discharge port.

Where an insert is used as the flow disrupter (or part thereof in conjunction with internal chamber wall protrusions and/or funnel-shaped internal chamber end walls) one or more elements in the collective form of an insert can be received within the internal chamber of the nozzle. Preferably, these elements each function as a baffle and are connected together as an integral unit. Also, this insert is preferably removably received within the internal chamber for purposes of cleaning and replacement.

The nozzle can be inexpensively manufactured from one element in any number of conventional manners, and in most preferred forms requires no assembly or maintenance (other than cleaning). Because condiment contacting surfaces of the nozzle are easily accessible, the nozzle can be easily cleaned and is suitable for use with food dispensing equipment.

Further objects and advantages of the present invention, together with the organization and manner of operation thereof, will become apparent from the following detailed description of the invention when taken in conjunction with the accompanying drawings, wherein like elements have like numerals throughout the drawings.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF THE PREFERRED EMBODIMENTS

Figure 1:
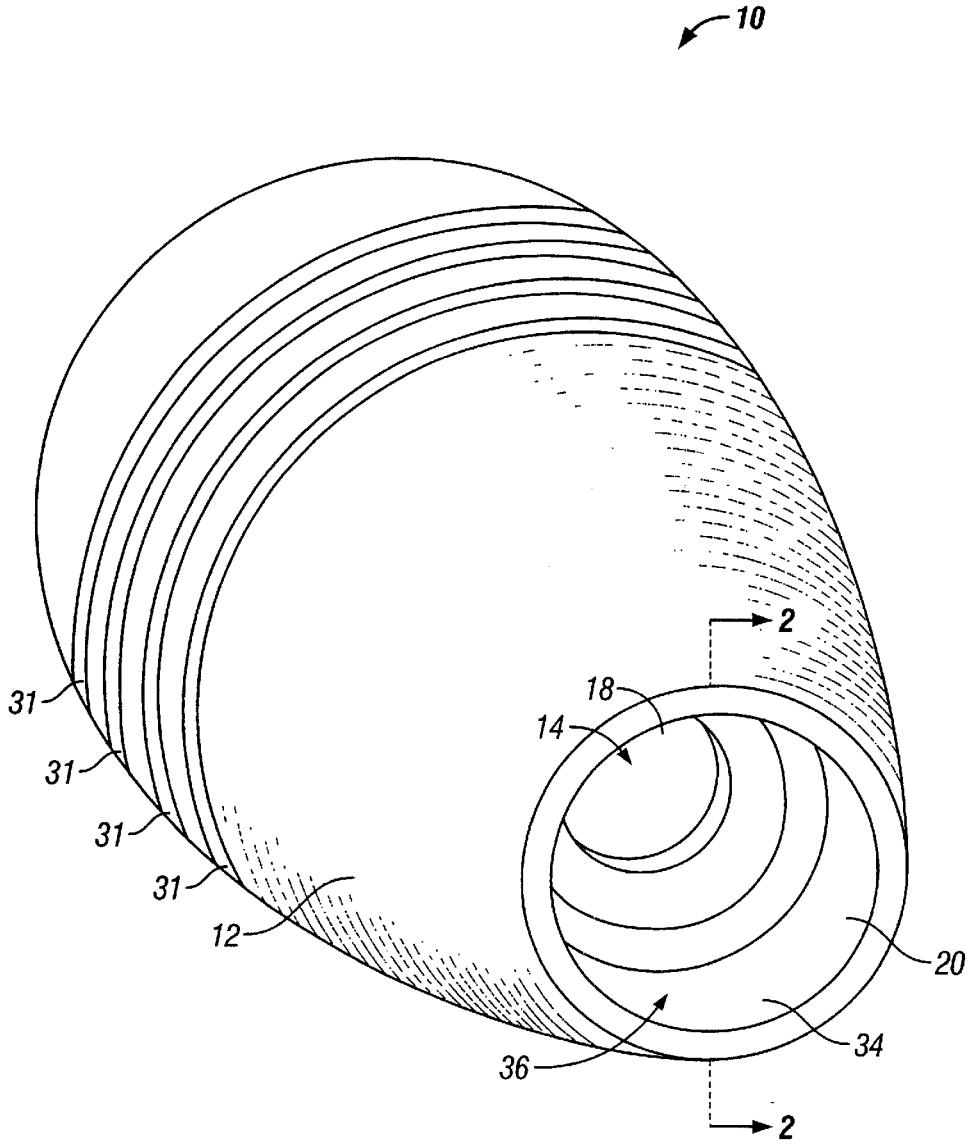
FIG. 1 is perspective view of a nozzle according to a first preferred embodiment of the present invention, viewed from the front of the nozzle.
Figure 2:
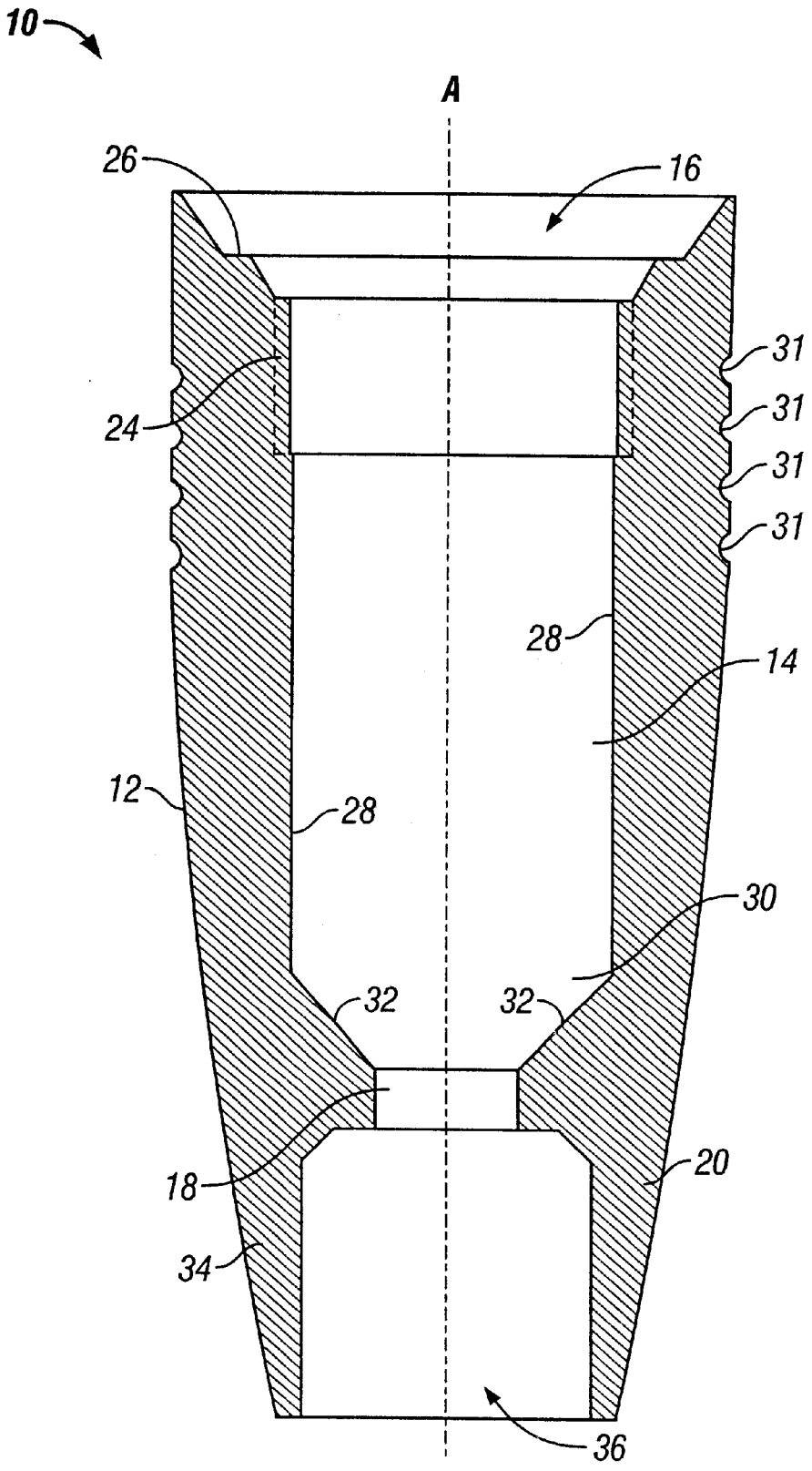
FIG. 2 is a cross-sectional view of the nozzle shown in FIG. 1, taken along lines 2—2 of FIG. 1.

With reference to FIGS. 1 and 2, the nozzle of the present invention, indicated generally at 10, is preferably an integral element made from any material acceptable for contact with food under applicable health regulations. Specifically, the nozzle 10 can be made from any durable, corrosion-resistant, and nonabsorbent material that is resistant to pitting, chipping, crazing, scratching, scoring, distortion, and decomposition. Examples of such material are food-grade plastic, metal, ceramic, and composites. Although the nozzle 10 is preferably an integral element manufactured in any conventional manner (such as by injection molding, machining, casting, extruding, rolling, stamping and the like), it should be noted that the nozzle 10 can be assembled from multiple elements, such as by one or more elements connected together by threaded joints, by snap, clearance, or interference fits, by press-fitting, welding, soldering, or brazing, by adhesive or other bonding agents, by one or more conventional fasteners (including without limitation threaded fasteners, rivets, clamps, and the like), by one or more conventional swage, taper-lock, quick-disconnect, or other joints, etc. Where connection materials such as adhesive or welding, brazing or soldering material is employed to connect elements of the nozzle 10 together, such connection materials should be acceptable for use with food dispensing equipment, more preferably should be acceptable for use with acidic foods such as ketchup and mustard, but most preferably should be out of contact with condiment passing through the nozzle 10. In highly preferred embodiments such as the embodiment shown in FIGS. 1 and 2, the nozzle 10 is defined by a nozzle body 12 machined from a single piece of food-grade plastic.

With continued reference to FIGS. 1 and 2, the nozzle body 12 has an internal chamber 14, a condiment input port 16, and a condiment output or discharge port 18. Preferably, the nozzle body 12 also has an extension 20 extending from a position adjacent to the condiment discharge port 18 for purposes that will be described in more detail below.

The nozzle 10 is preferably removably attachable to a tap 22 (see FIG. 10) in any conventional manner, such as by a light interference fit upon or within the tap spout, a threaded connection with the tap spout, by one or more clips or other mating fasteners on the nozzle 10 and spout, a swage or other conventional pipe fitting, and the like. In the highly preferred embodiment shown in FIGS. 1 and 2, the nozzle body has internal threads 24 adjacent to the condiment input port 16 permitting the nozzle 10 to thread onto a standard externally-threaded tap spout. As another example, the nozzle 10 can be connected to the tap spout by any conventional mechanical seal, such as sets of mating threads on the nozzle 10 and tap spout that interengage and create a fluid-tight seal (with or without a gasket), a series of annular ribs on the nozzle 10 and tap spout that interlock with one another and deform to form a fluid-tight seal (with or without a gasket), and the like.

Referring again to the preferred embodiment shown in FIGS. 1 and 2, the nozzle body 12 preferably has a seat for receiving a gasket (not shown). The gasket can take any conventional form, but is preferably an O-ring gasket made of food-grade rubber or other non-absorbent material that is resistant to corrosion even from relatively acidic materials such as ketchup or mustard. When the nozzle 10 is threaded upon the spout of the tap 22, the gasket is preferably compressed in its seat 26. The seal created by the gasket is preferably air-tight to prevent air from entering the nozzle 10 between the nozzle 10 and the tap 22. As is well recognized by those skilled in the art, air entering in this manner can generate undesirable condiment spits and splatters upon exiting from the nozzle 10. The seal also functions to prevent condiment leakage between the tap 22 and the nozzle 10.

Figure 10:
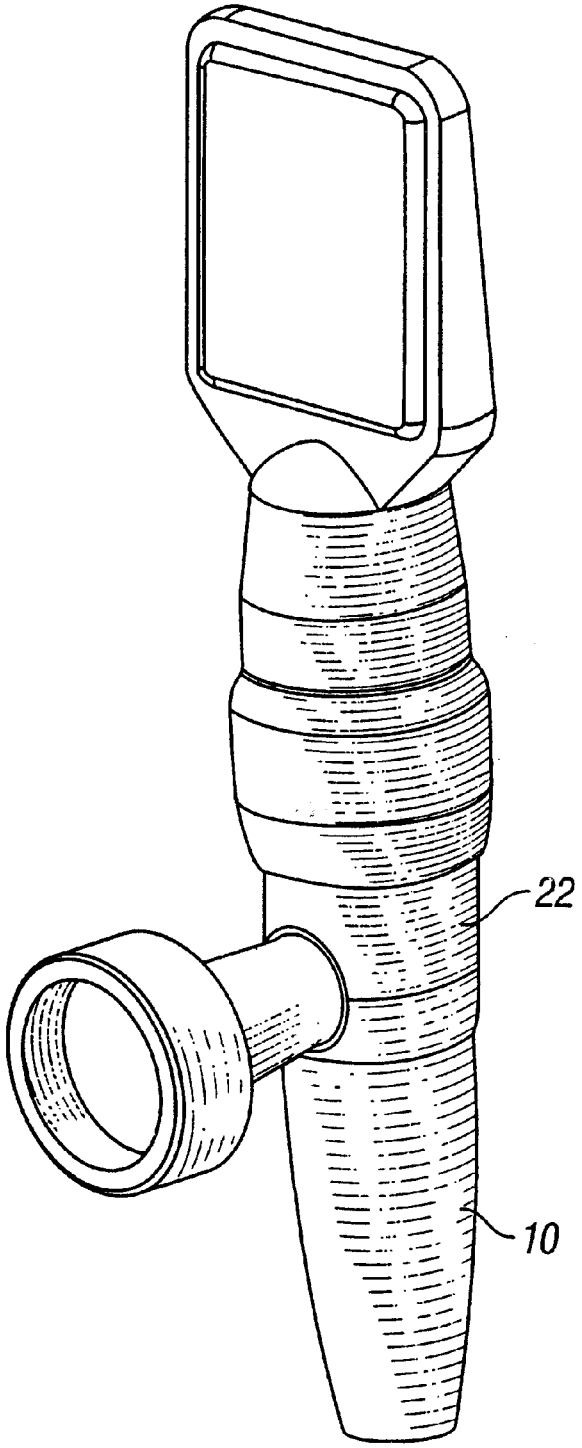
FIG. 10 is a rear perspective view of a nozzle according to the present invention, shown installed upon a condiment dispensing tap.

In the illustrated preferred embodiment of the nozzle 10, the input port 16 is substantially aligned or coaxial with the internal chamber 14 as shown in FIGS. 1 and 2. However, the input port 16 can be located on a side of the internal chamber 14 in other embodiments of the present invention. In such cases, the input port 16 is preferably located near an end of the internal chamber 14 opposite the condiment discharge port 18. When connected to the tap 22, the nozzle 10 and the internal chamber 14 can be oriented at virtually any angle with respect to the spout of the tap 22, but preferably is angled between 0 degrees (aligned with the spout of the tap 22 as shown in FIG. 10) and 90 degrees with respect the spout of the tap 22. The connection of the nozzle 10 to a tap 22 can be made in any of the manners described above (i.e., threaded connection, quick-disconnect, and the like).

Although the nozzle 10 is preferably removably attachable to a tap 22 for purposes of nozzle and tap cleaning, nozzle replacement if damaged, nozzle changeout when a different condiment is to be dispensed from the tap 22, and the like, it should be noted that several advantages of the present invention are realized even if the nozzle is permanently attached to the tap 22 in any conventional manner. The nozzle 10 can even be integral with the tap 22 if desired, in which case the spout of the tap 22 preferably has the nozzle features described herein. In short, the present invention lies not in the manner of attachment of the nozzle 10 to a tap 22 (or even whether there exists a nozzle separately identifiable from a tap spout), but in the features described herein for condiment dispensing. As such, use of the term "nozzle" herein and in the appended claims is understood to encompass tap spouts as well as nozzles. For purposes of description however, the present invention will hereinafter continue to be described with reference to a nozzle separate and detachably connected to a conventional tap spout.

It should also be noted that the preferred nozzle and tap arrangement illustrated in FIG. 10 is only one example of the use of the present invention. The nozzle features of the present invention can be employed regardless of whether the valve controlling condiment flow to the nozzle 10 is immediately upstream of the nozzle (e.g., in the tap 22 shown in FIG. 10) or is farther upstream by any greater distance, or even whether a tap as shown in FIG. 10 is employed at all.

The internal chamber 14 is in fluid communication with the condiment input port 16 and the condiment discharge port 18, and is preferably larger in cross section than the aperture of the spout (not shown) to which the nozzle 10 is connected. Therefore, the internal chamber 14 preferably acts as an expansion chamber into which condiment enters and slows due to the higher volume available to the condiment. Internal chambers 14 not having a larger cross sectional shape than that upstream of the nozzle 10 can be used in the present invention, but may not generate this preferred result.

The internal chamber 14 is preferably elongated in shape as shown in FIGS. 1 and 2, thereby permitting sufficient room for reduction in condiment pressure and for condiment flow deceleration from the condiment input port 16 to the condiment discharge port 18. Also, the majority of the length of the internal chamber 14 has a substantially constant cross section as illustrated. However, it will be appreciated by one having ordinary skill in the art that the side walls 28 of the internal chamber 14 can be angled, stepped, curved, or otherwise oriented with respect to the nozzle's longitudinal axis A so that the cross section of the internal chamber 14 increases or decreases along the axis A toward the condiment discharge port 18. Such a cross section change can be constant or gradual as desired by employing side walls 28 having a constant angle with respect to axis A or having a varying angle with respect to the axis A (respectively) in different locations along the axis A. An internal chamber 14 having multiple portions along the axis A in which the cross-sectional area of the internal chamber 14 increases and decreases at a constant or varying rate is also possible, such as a first chamber portion adjacent to the input port 16 in which the side walls 28 flare outward in a direction toward the condiment discharge port 18, followed by a second (downstream) chamber portion in which the side walls 28 converge to some degree toward the condiment discharge port 18. One or both such chamber portions can have walls that are substantially flat or that are curved (present a convex or concave surface to the internal chamber 14). Other internal chamber shapes are possible and fall within the spirit and scope of the present invention. Preferably however, the internal chamber 14 has a substantially constant cross sectional area along at least a portion of its length from the input port 16, and more preferably along a majority of its length from the input port 16.

The nozzle of the present invention preferably includes a flow disrupter for agitating, interrupting, or otherwise disrupting condiment flow within the internal chamber 14. The flow disrupter thereby acts to reduce pressure in the condiment flow (and also preferably to reduce flow speed) for better control condiment discharge control. The flow disrupter can take a number of different forms any one or more of which can be included in various embodiments of the present invention. For example, the flow disrupter can be defined by the end portion 30 of the internal chamber 14 as will now be described.

The internal chamber 14 can end in a wall that is substantially orthogonal to the axis A, but more preferably has an end portion 30 that is tapered or curved to better funnel condiment toward the condiment discharge port 18. As shown in FIG. 2, the end portion 30 is preferably funnel-shaped with walls 32 converging toward the axis A at a constant rate (i.e., substantially flat walls). Preferably, the walls 32 of the end portion 30 are disposed at an angle with respect to the axis A (facing the internal chamber 14) of between 30 and 90 degrees. More preferably, this angle is between 40 and 60 degrees. Most preferably, this angle is about 45 degrees as shown in FIG. 2.

Like the side walls of the internal chamber 14, the walls 32 of the internal chamber's end portion 30 can take a number of other forms different from that shown in FIG. 2. For example, the end portion walls in another preferred embodiment are curved to present a concave or dish-shaped surface toward the internal chamber 14. These end portion walls can have a constant or non-constant radius of curvature as desired. As with the side walls 28, the end portion walls 32 can alternatively be stepped or staged to have different degrees of convergence to the axis A at different points along the axis A. For example, a first portion of the end portion walls 32 adjacent to the discharge port 18 can be oriented at an acute angle with respect to the axis that is larger or smaller than the angle of a second portion of the end portion walls 32 farther upstream from the condiment discharge port 18. Also, the end portion walls 32 can be partly curved and partly straight along the axis A as desired. It should be noted that the end portion walls 32 need not necessarily be distinguished from the side walls 28 of the internal chamber 14 by a relatively sharp angle as shown in FIG. 2. Instead, the side walls 28 can "blend" into the end portion walls 32 via a bow or curve that is gentle or pronounced. In less preferred embodiments of the present invention, the side walls 28 can be substantially indistinguishable from the end portion walls 32, particularly where the side walls 28 converge all the way to the condiment discharge port 18.

With continued reference to FIG. 2, the walls 32 of the internal chamber end portion 30 preferably terminate in the condiment discharge port 18. However, the output port 18 can instead be separated from the end portion walls 32 by one or more steps, countersinks, lips, or other surface features.

As an alternative to the single internal chamber 14 described above and illustrated in the figures, the nozzle body 12 can have multiple internal chambers in series or in parallel to one another. In other words, the nozzle body 12 can be arranged so that condiment passing through the nozzle body 12 passes through two or more internal chambers in succession or is divided at some point along the axis A into two or more side-by-side internal chambers. In either case, each chamber preferably has the features described above with reference to the single internal chamber 14 (preferably including end portion walls 32 as also described above).

The condiment discharge port 18 of the nozzle 10 is preferably defined by one or more apertures at a downstream end of the internal chamber 14. The condiment discharge port 18 shown in the preferred embodiment of FIGS. 1 and 2 is a single aperture centrally located and substantially aligned with the internal chamber 14 on the axis A. In other embodiments of the present invention, the condiment discharge port 18 has two or more apertures preferably located close to one another or otherwise grouped about the axis A.

The size and number of apertures defining the condiment discharge port 18 is preferably selected based upon the type of condiment being dispensed through the nozzle 10. For example, for a relatively low viscosity condiment such as vinegar, with a viscosity of 0–99 cps, a group of three to five (and more preferably four) apertures each having about a 0.03 inch (0.08 cm) diameter is preferred. For a higher viscosity condiment such as vegetable oil, with a viscosity of 100–499 cps, a group of three to five (and preferably four) apertures each having about a 0.06 inch (0.15 cm) diameter is preferred. Where an even higher viscosity condiment such as ketchup, with a viscosity of 500–999 cps, a 0.13 inch (0.33 cm) diameter aperture is preferred. For a condiment having a viscosity of 1000–3499 cps such as mustard or light mayonnaise, a 0.19 inch (0.48 cm) diameter aperture is preferred. For a fairly viscous condiment such as heavy mayonnaise, a 0.25 inch (0.64 cm) diameter aperture is preferred. It will be appreciated that a dispensing system or device employing the present invention in detachable form can have a series of interchangeable nozzles, permitting a user to select and attach a nozzle (having a discharge port with a known number of apertures and aperture diameters) to a tap based upon the type of condiment to be dispensed. Therefore, the present invention can take the form of two or more nozzles defining a nozzle set used for multiple condiment types. The nozzles in such a set would at least have differing numbers of apertures in their respective discharge ports 18 and/or different aperture diameters.

If desired, nozzles having different condiment discharge ports 18 can be marked to be readily distinguishable by a user. For example, the nozzles 10 can have differing numbers of external grooves or scores 31, ribs, or bumps signifying the nozzle discharge port type. As another example, the nozzles 10 can be colored or can be labeled, printed, or otherwise marked to identify their respective discharge port types. Still other manners of distinguishing nozzle types are possible and fall within the spirit and scope of the present invention.

As described above and shown in FIGS. 1 and 2, the condiment discharge port 18 is preferably centrally located and aligned with respect to the internal chamber 14. Although this arrangement is preferred, other embodiments of the present invention employ condiment discharge ports 18 located in a non-central or non-aligned location with respect to the internal chamber 14. For example, the condiment discharge port 18 can be located closer to one side of the nozzle body 12 than to another, or can be located adjacent to one side wall 28 of the internal chamber 14. In such cases, the walls 32 of the chamber end portion 30 still preferably extend from the side walls 28 to the condiment discharge port 18, and therefore do not have symmetry about the axis A, and can have varying steepnesses and/or varying curvatures about the circumference of the condiment discharge port 18.

The extension 20 extending from adjacent to the condiment discharge port 18 serves the purpose of shielding condiment flow from passing at a significant lateral trajectory from the condiment discharge port 18. Condiment can have such a trajectory when air is in the condiment or when the condiment has separated into different parts (e.g., water has separated from mustard or ketchup in the nozzle or in upstream fluid lines by being stationary for a period of time). Very likely, only a portion of the condiment has such a trajectory, while the remainder of the condiment is discharged substantially straight through the condiment discharge port 18 or at only a slight angle therefrom. The extension 20 therefore acts to divert that portion of the condiment exiting laterally from the condiment discharge port 18 (at a relatively large angle from axis A) to a trajectory more closely aligned with that of the condiment discharge port 18.

The extension 20 can take a number of different forms performing the functions just described, but most preferably is a skirt 34 extending from a position around the condiment discharge port 18. The skirt 34 defines a recess 36 substantially open at an end opposite the condiment discharge port 18. The skirt 34 is preferably a uniform length around the condiment discharge port 18, but this need not necessarily be the case. Also, the skirt 34 need not extend fully around the condiment discharge port 18, and can extend around any desired portion thereof. However, a skirt 34 fully surrounding the condiment discharge port 18 is most preferred because it shields against lateral condiment discharge in all directions around the condiment discharge port 18.

The extension 20 can instead be a series of walls or raised portions of the nozzle body 12 around the condiment discharge port 18. These walls can be separate from one another, but more preferably are connected to at least partially surround the condiment discharge port 18.

Preferably, the extension 20 is a terminal portion of the nozzle body 12 as shown in FIGS. 1 and 2. The extension 20 can instead be defined by a separate element or series of elements (e.g., blocks, walls, posts, and the like) removably or permanently attached to the nozzle body 12 adjacent to the condiment discharge port 18 in any conventional manner, such as those described above with reference to multiple-part nozzle bodies.

Regardless of the form of the extension 20, the discharge recess 36 defined thereby can take a number of different shapes capable of performing the above-described shielding and diverting functions. Preferably, the internal surfaces of the discharge recess 36 are substantially parallel to the axis of the condiment discharge port 18 so that laterally-discharged condiment is diverted to a path substantially aligned with the condiment discharge port 18. In other embodiments of the present invention, the discharge recess 36 be tapered, opening toward or away from the condiment discharge port 18.

In operation, the nozzle 10 is connected to a tap 22 (if separate therefrom as described above) and the tap 22 is manipulated to permit condiment to flow into the internal chamber 14 via the condiment input port 16. In highly preferred embodiments of the present invention, the nozzle 10 is oriented in a substantially vertical manner when connected to the tap 22. Although not required to practice the present invention, such an orientation helps to prevent air from entering the nozzle 10 from the condiment discharge port 18 during discharge operations, such as when a suck-back valve is operated upstream of the nozzle 10 to draw dangling fluid or fluid buildup back into the nozzle 10 following condiment dispense.

Because in highly preferred embodiments the internal chamber 14 is larger in cross-section than the outlet of the tap to which it is connected, condiment pressure drops upon entry into the internal chamber 14. Condiment pressure is thereby preferably lowered in the internal chamber 14 to provide better control over the condiment flow and to properly direct the flow to and through the condiment discharge port 18. Preferably, the condiment passes through the internal chamber 14 until it reaches the end portion 30 thereof. Condiment pressure through the internal chamber 14 is preferably substantially unaffected by the side walls 28, but can be increased or decreased as desired by selecting a varying internal chamber cross sectional area along the internal chamber 14 (see the description above for different possible internal chamber shapes).

Upon reaching the end portion 30 of the preferred nozzle embodiment shown in FIGS. 1 and 2, condiment flow is constricted as condiment flow adjacent to the walls of the internal chamber 14 is directed radially by the end portion walls 32 toward the center of the internal chamber 14. Where the condiment discharge port 18 is not centrally located with respect to the internal chamber 14, the end portion walls 32 still preferably divert condiment flow toward the condiment discharge port 18, but do so in a non-symmetrical manner.

As mentioned above, the funnel or dish-shaped internal chamber end portion 30 is a flow disrupter causing flow to be diverted as just described, thereby generating crossflow in the end portion 30 especially immediately upstream of the condiment discharge port 18. This crossflow generates turbulence in the condiment flow, thereby further dissipating line pressure and flow force immediately upstream of the condiment discharge port 18 and just prior to condiment dispense. This disruption in the condiment prior to exiting from the discharge port also performs the function of mixing condiment. This is particularly desirable for condiment that is subject to settling or separating into constituent parts, such as water and mustard or ketchup, oil and vinegar, and the like.

As the turbulent flow of condiment exits the condiment discharge port 18, at least some portion of the flow may have a lateral trajectory. This portion of the flow eventually impacts the extension 20 past the condiment discharge port 18, and is thereby diverted to a trajectory more aligned with the condiment discharge port 18. The user and surrounding surfaces are thereby shielded from condiment spray and splatter (if any).

Because the condiment discharge port 18 has preferably been selected based upon the type of condiment being dispensed as described above, condiment within the internal chamber 14 does not continue to exit the condiment discharge port 18 after a dispensing operation. Specifically, the viscosity of the condiment in combination with the cross-sectional shear exerted by the converging flow upon condiment at the end portion 30 of the internal chamber 14 preferably exceeds the force exerted by the weight of the condiment at the condiment discharge port 18, thereby preventing unwanted drips from the nozzle 10.

In the event that excess condiment that has passed through the condiment discharge port 18 still remains dangling from the condiment discharge port 18, the extension 20 performs additional functions of hiding the excess condiment from view of the user and partially enclosing the excess condiment from exposure to the surroundings. These functions help to improve the appearance of the nozzle 10 and to lower the chances of condiment contamination.

Figure 3:
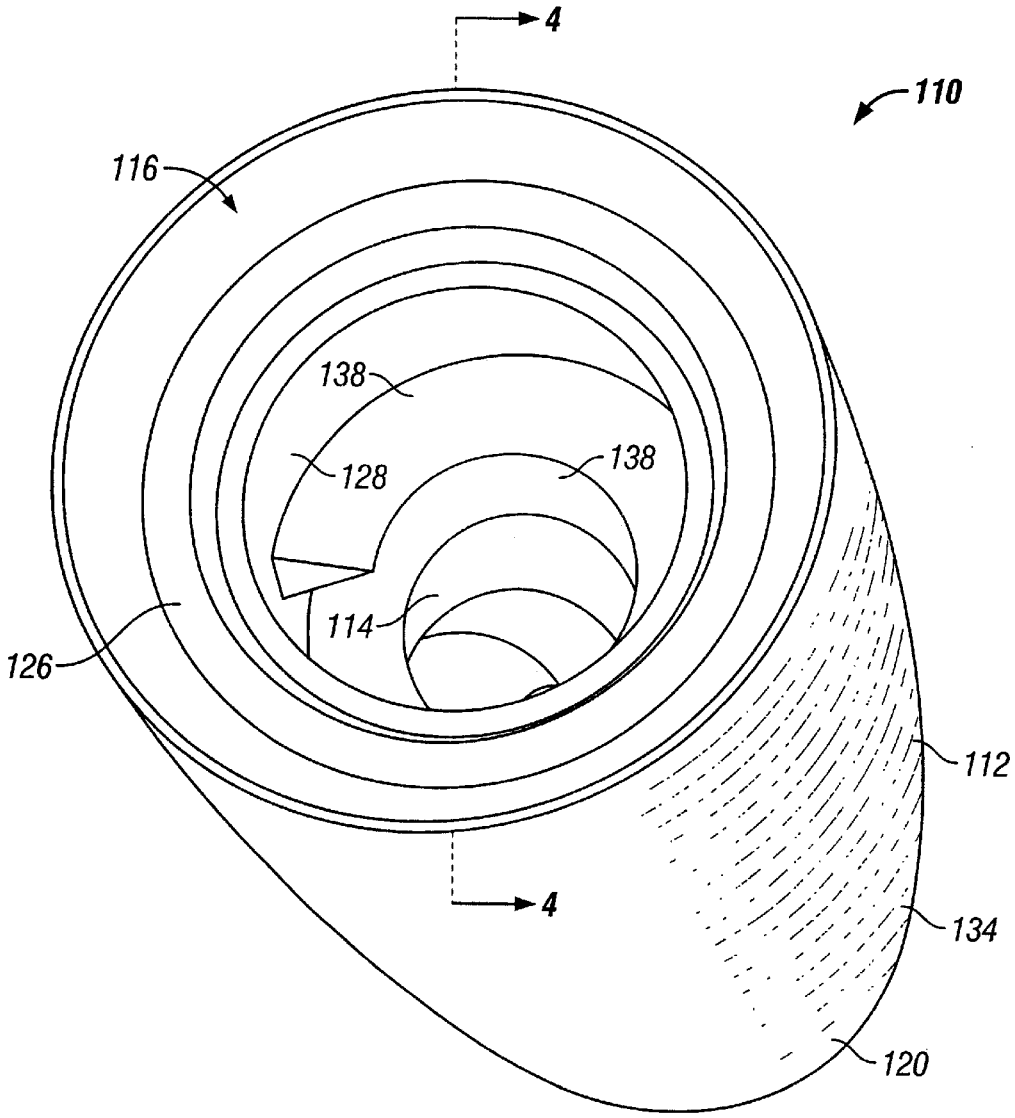
FIG. 3 is a perspective view of a nozzle according to a second preferred embodiment of the present invention, viewed from the rear of the nozzle.
Figure 4:
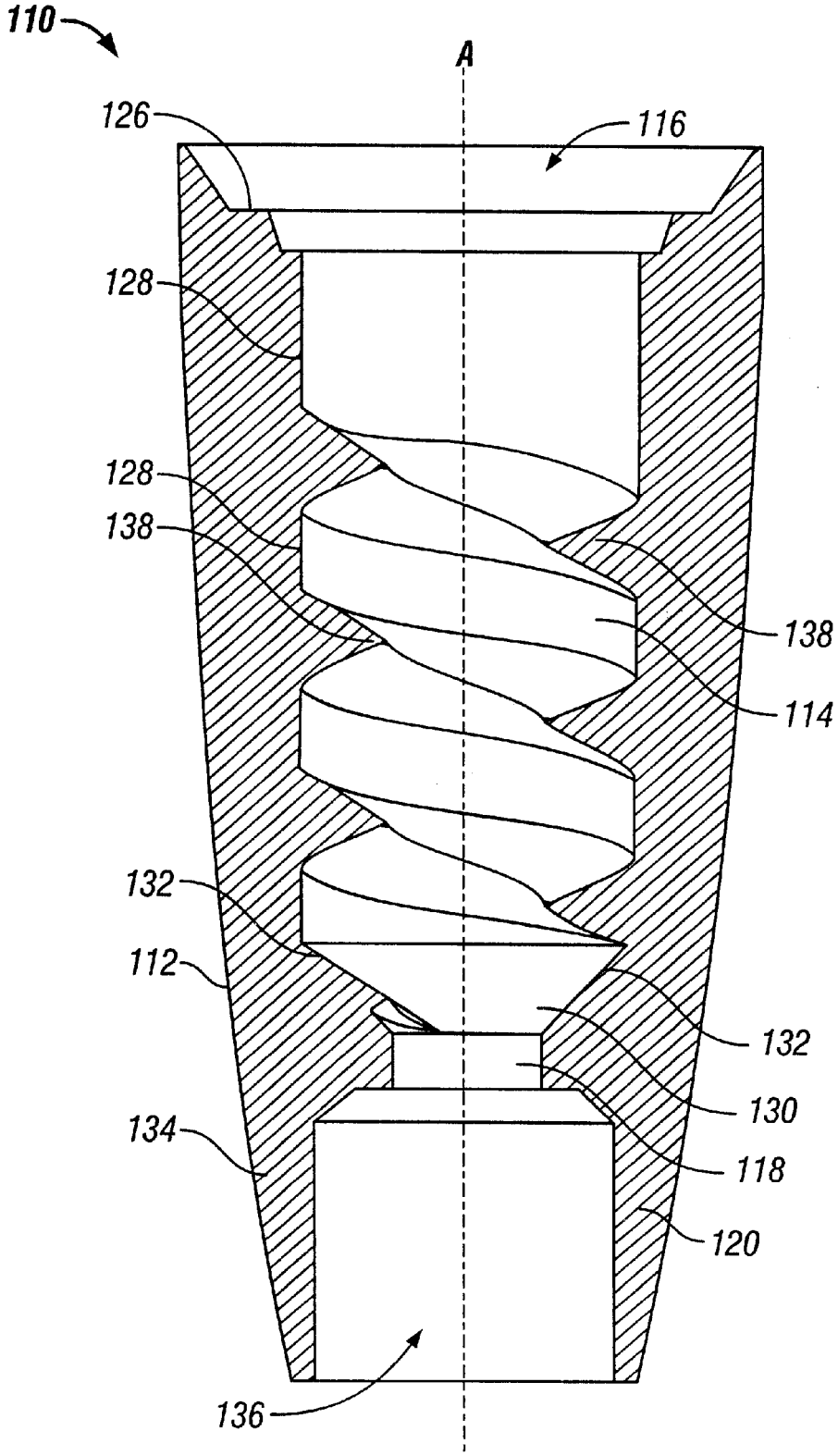
FIG. 4 is a cross sectional view of the nozzle shown in FIG. 3, taken along lines 4—4 of FIG. 3.
Figure 5:
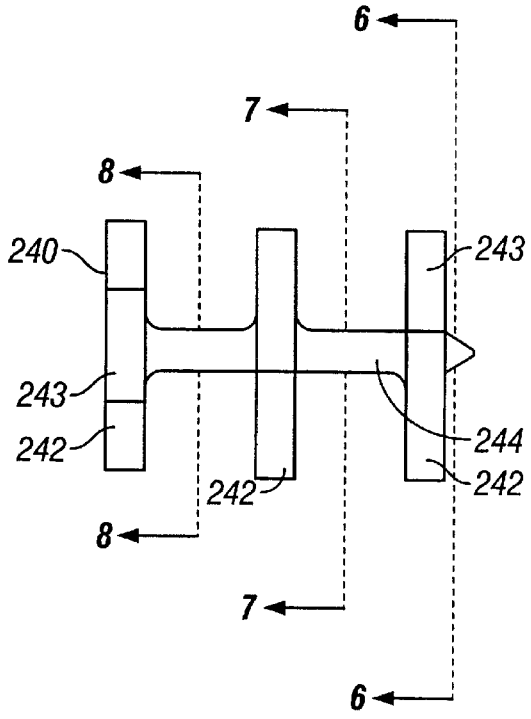
FIG. 5 is a side elevational view of an insert for use with a nozzle in a third preferred embodiment of the present invention.
Figure 6:
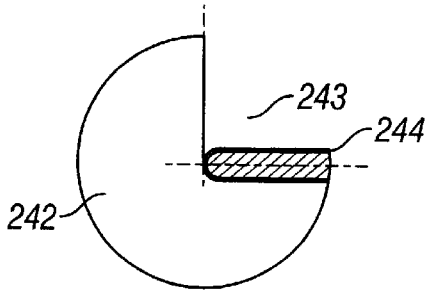
FIG. 6 is a cross-sectional view of the insert shown in FIG. 5, taken along lines 6—6 of FIG. 5.
Figure 7:
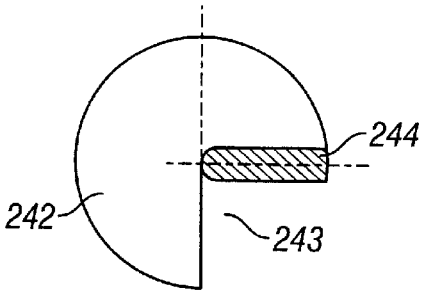
FIG. 7 is a cross-sectional view of the insert shown in FIG. 5, taken along lines 7—7 of FIG. 5.
Figure 8:
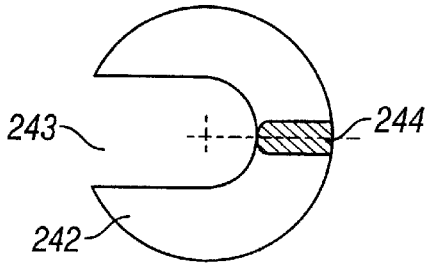
FIG. 8 is a cross-sectional view of the insert shown in FIG. 5, taken along lines 8—8 of FIG. 5.
Figure 9:
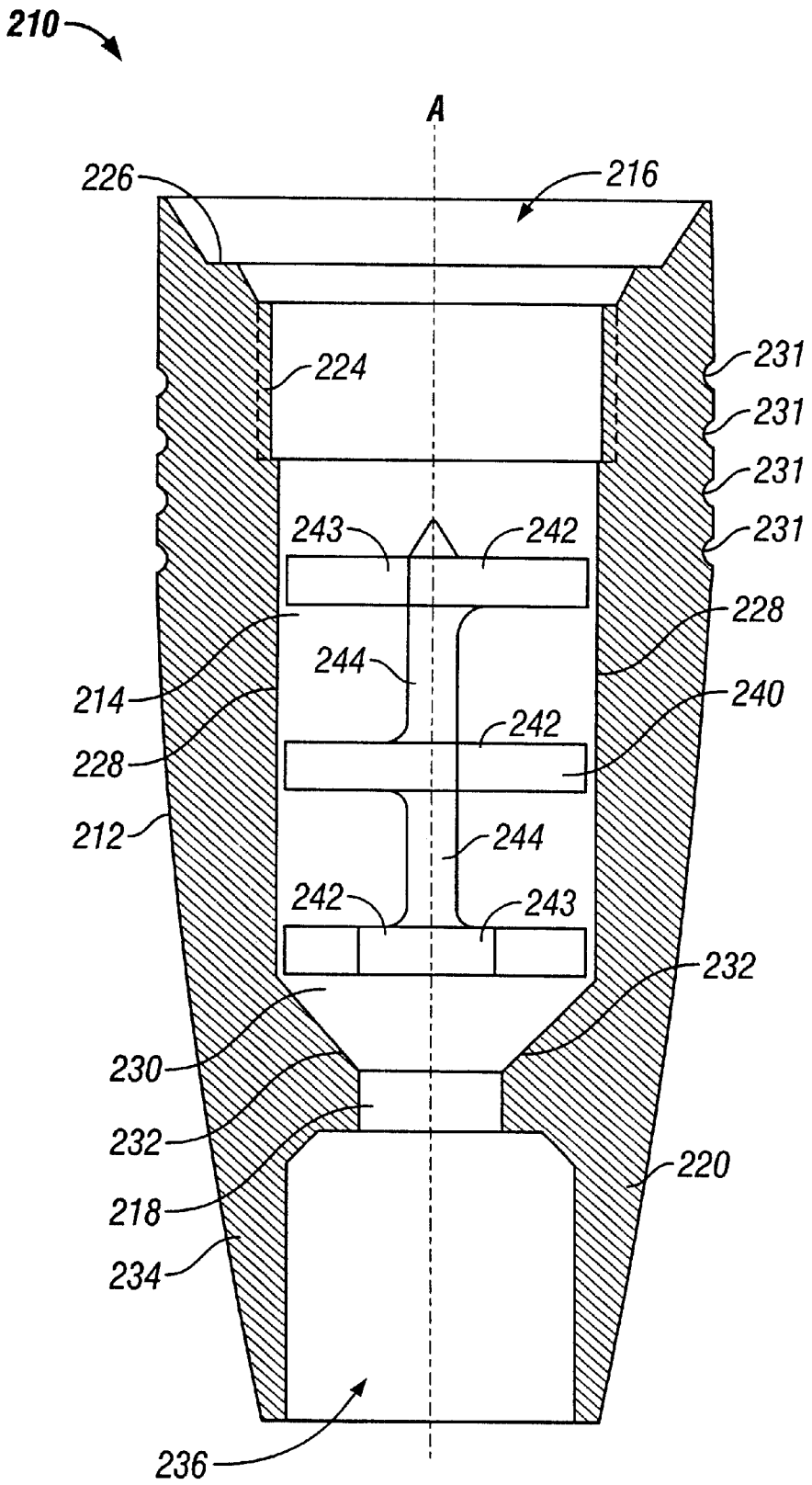
FIG. 9 is a cross-sectional view of a nozzle and insert assembly according to the third preferred embodiment of the present invention.

As mentioned above, it is desirable to lower pressure and fluid force in the expansion chamber 14 for more control over condiment dispense. The nozzle 10 in the preferred embodiment described above and illustrated in FIGS. 1 and 2 performs this function by employing an internal chamber 14 having a larger cross-sectional area than the outlet of the tap to which the nozzle 10 is connected and by diverting condiment upstream of the condiment discharge port 18 to generate crossflow and turbulence. FIGS. 3 and 4 and FIGS. 5–9 illustrate two additional manners in which these functions can be performed. The nozzles shown in FIGS. 3–9 are substantially the same as nozzle 10 of the first preferred embodiment and operate in substantially the same manner, with the exceptions noted below. Accordingly, features and elements of the nozzle 110 in FIGS. 3 and 4 are numbered in the 100 series corresponding to the reference numerals of the first preferred embodiment, while features and elements of the nozzle 210 in FIG. 9 are numbered in the 200 series also corresponding to the reference numerals of the first preferred embodiment.

With reference first to the nozzle embodiment shown in FIGS. 3 and 4, the pressure of condiment flow in the internal chamber 114 of the nozzle 110 can be further reduced by another type of flow disrupter diverting condiment flow away from a path leading directly toward the condiment discharge port 118. To divert the condiment flow in this manner, the internal chamber 114 preferably employs a flow disrupter defined at least partially by protrusions 138 extending from the side walls 128. These protrusions 138 extend into the internal chamber 114 sufficiently far to disrupt condiment flow therethrough and preferably to generate turbulent flow by the time condiment reaches the end portion 130 of the internal chamber 114. The protrusions 138 can take any number of shapes and forms, each one of which disrupts condiment flow and preferably induces turbulence as just described. In the illustrated preferred embodiment, the protrusions 138 are in the form of a rib spiraling down the side walls 128 of the internal chamber 114. The tip of the rib (farthest into the center of the internal chamber 114) is preferably as far into the internal chamber 114 as possible to disrupt flow passing through the center of the internal chamber 114, while the remainder of the rib preferably forces condiment flow to follow a circuitous or spiral path on its way through the internal chamber 114. Both functions help to reduce condiment pressure and force in the internal chamber 114. Although the rib 138 can extend partially into the internal chamber 114 as shown, the rib 138 can extend across the center of the internal chamber 114, or can be less pronounced and closer to the side walls 128 as desired. Also, the pitch of the rib 138 can be selected to be of any steepness.

It should be noted that not all protrusions 138 from the side walls 128 need to generate a vortex flow as can the rib described above. Instead, the protrusions 138 can be one or more ribs, posts, bumps, walls, plates, or other elements extending toward or even past the center of the internal chamber 114 to disrupt some or all of the condiment flow through the internal chamber 114 and/or to generate a serpentine, random, or other circuitous flow path through the internal chamber 114. Each such element is a flow disrupter, functioning (like the rib of the illustrated preferred embodiment) as a baffle to disrupt, divert, and/or slow condiment flow through the internal chamber 114. Any number of these protrusions or baffles 138 can be employed, and need not necessarily be arranged in any pattern or order (as are the regularly-spaced spirals of the rib 138 shown in FIGS. 3 and 4). In addition, the protrusions 138 can be integral with the nozzle body 112, can be separate elements attached thereto in any conventional manner, or can be part of an insert received within the internal chamber 114. An example of such an insert is illustrated in FIGS. 5–9.

With reference first to FIG. 9, the nozzle 210 illustrated therein is preferably substantially the same as the nozzle 10 of the first preferred embodiment. However, the nozzle 210 employs yet another type of flow disrupter in addition to the funnel-shaped end portion 230 of the internal chamber 214. Specifically, the nozzle has a nozzle insert 240 received within the internal chamber 214 to disrupt, divert, and slow condiment flow therethrough. The nozzle insert 240 is preferably removably received within the internal chamber 214 for purposes of cleaning and replacement, and is retained in the internal chamber 214 by the side walls 228 and end portion walls 232 of the nozzle body 212 and by the end of the tap spout (not shown). In less preferred embodiments of the present invention, the nozzle insert 240 can be secured within the internal chamber 214 in any conventional manner, including without limitation by being glued, fastened with conventional fasteners, welded, brazed, or press fit in the internal chamber 214.

The nozzle insert 240 has at least one baffle 242, and more preferably has a series of baffles 242 as shown in FIGS. 5–9. The baffles 242 are preferably plate shaped as shown in the figures, but can take any other shape desired. To provide a circuitous path for condiment flow through the internal chamber 214, the baffles 242 are preferably arranged one atop the other with a fluid flow space therebetween. Condiment flows past a notch or aperture 243 in each baffle 242 to the space therebehind, after which the condiment is forced to change direction to pass to the next notch or aperture 243 in the succeeding baffle 242. Where the nozzle insert 240 has two or more baffles 242, the baffles 242 can be connected together by a post 244 as illustrated or by one or more walls, bars, plates, rods, or other elements extending from baffle 242 to baffle 242. Most preferably, the baffles 242 and the element(s) connecting the baffles 242 are a single integral unit. However, these elements can instead be separate and assembled together in any conventional manner.

The nozzle insert 240 flow disrupter described above and illustrated in FIGS. 5–9 is one type of insert that can be received within the internal chamber 214 of the nozzle 210 for disrupting, diverting, and/or slowing condiment flow therethrough. Other types of flow disrupter inserts employing baffles having different shapes (including without limitation plate, bar, or rod shapes) and arrangements are possible and fall within the spirit and scope of the present invention. Most preferably, each such alternative nozzle insert is a single element having multiple baffles and is removably received within the internal chamber 214.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

Figure 11:
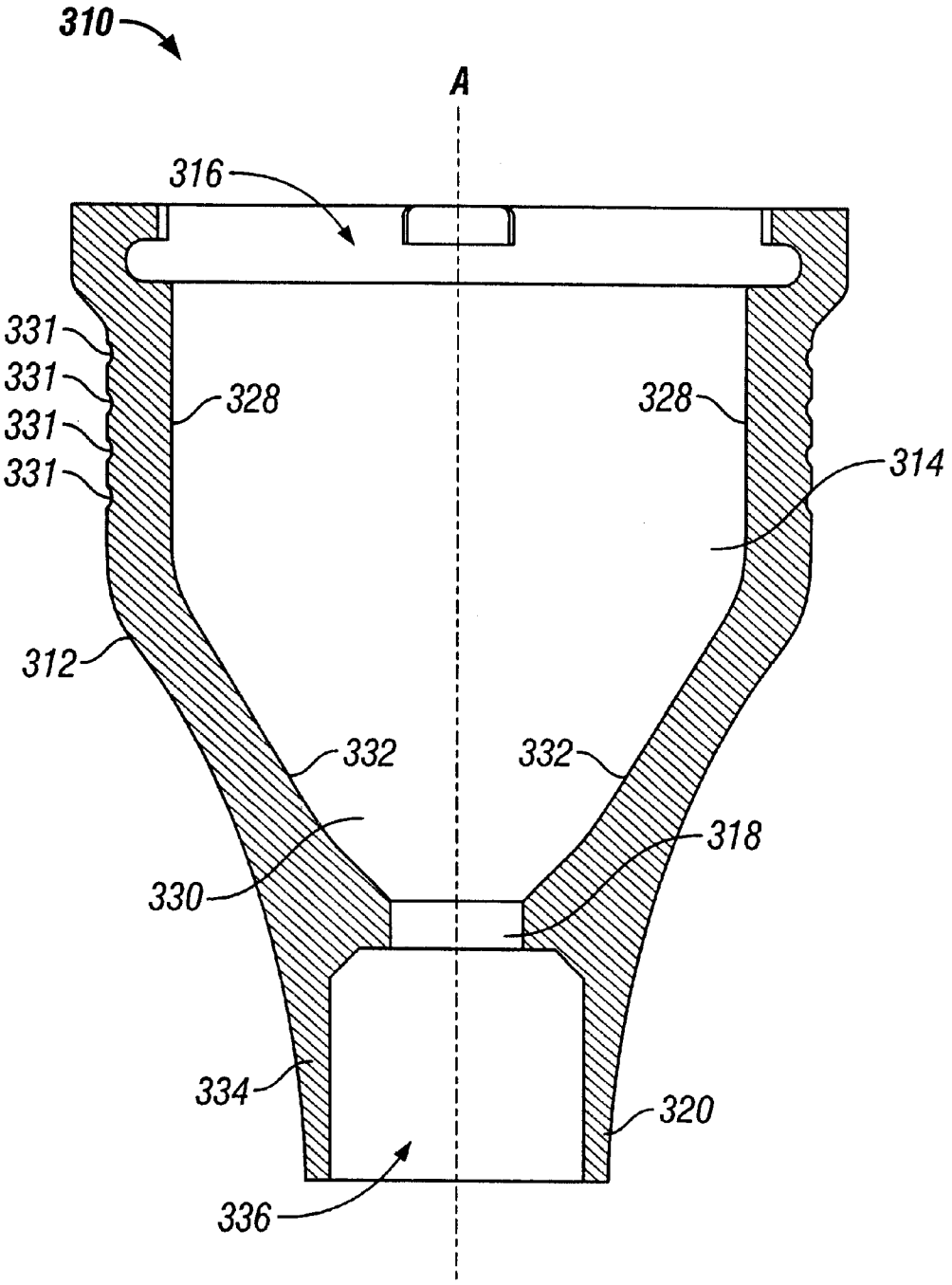
FIG. 11 is a cross-sectional view of a nozzle according to a fourth preferred embodiment of the present invention.

For example, the nozzle 10, 110, 210, nozzle body 12, 112, 212, internal chamber 14, 114, 214, internal chamber end portion 30, 130, 230, and extension 20, 120, 220 can have a number of different lengths, widths, or cross-sectional shapes. While a relatively elongated and straight internal chamber 14, 114, 214 is preferred (thereby at least partially defining a relatively elongated nozzle 10, 110, 210 and nozzle body 12, 112, 212), the internal chamber 14, 114, 214 can be significantly shorter than that shown in FIGS. 1–4 and 9. Longer internal chambers are also possible. Also, internal chamber shapes can be significantly different, such as an internal chamber that gradually narrows or expands toward the condiment discharge port 18, 118, 218 by virtue of angled or curved internal chamber side walls 28, 128, 228. Similar features are possible with regard to the discharge recess 36, 136, 236 of the nozzle 10, 110, 210. One example of an alternative nozzle is illustrated in FIG. 11, where the nozzle 310 has a shorter and wider internal chamber 314 and a larger internal chamber end portion 330 that is staged (a stage near the discharge port 318 having slightly shallower end portion walls 332 than those of another immediately upstream stage). Other examples of alternative nozzles are possible and fall within the spirit and scope of the present invention.

It should also be noted that the cross sections of the various nozzle elements need not necessarily be round such as is shown in FIGS. 1–9. Specifically, the internal chamber 14, 114, 214, 314, the discharge recess 36, 136, 236, 336, the input port 16, 116, 216, 316, the aperture(s) of the condiment discharge port 18, 118, 218, 318, the end portion 30, 130, 230, 330 of the internal chamber 14, 114, 214, 314, the outer cross sectional shape of the nozzle body 12, 112, 212, 312, and/or the outer cross sectional shape of the extension 20, 120, 220, 320 can have a number of different cross sectional shapes along any length of the nozzle 10, 110, 210, 310. These shapes include without limitation oval, elliptical, square, rectangular, and polygonal shapes.

Although the nozzle 10, 110, 210, 310 of the present invention is preferably used in a substantially vertical orientation (i.e., the length of the nozzle 10, 110, 210, 310 oriented substantially vertically with the internal chamber 14, 114, 214, 314, condiment discharge port 18, 118, 218, 318, and discharge recess 36, 136, 236 336 oriented one above the other), the nozzle 10, 110, 210, 310 can be oriented and used in virtually any direction desired. In this regard, the internal chamber 14, 114, 214, 314, condiment discharge port 18, 118, 218, 318, and discharge recess 36, 136, 236, 336 need not necessarily be aligned along an axis A. For example, the internal chamber 14, 114, 214, 314 can be oriented at an angle with respect to the discharge recess 36, 136, 236, 336 (with the end portion 30, 130, 230, 330 having a bent shape and/or with the condiment discharge port 18, 118, 218, 318 located in an end portion wall 32, 132, 232, 332 at an angle with respect to the length of the internal chamber 14, 114, 214, 314). As another example, the internal chamber 14, 114, 214, 314 can have one or more angles or bends rather than be substantially straight as shown in the figures.

In each preferred embodiment described above, the nozzle 10, 110, 210, 310 preferably has one condiment input port 16, 116, 216, 316 and one condiment discharge port 18, 118, 218, 318 (possibly defined by a group of apertures). Alternative embodiments of the present invention can instead have more than one condiment input port 16, 116, 216, 316 fed in any conventional manner by more than one supply of condiment received within the internal chamber 14, 114, 214, 314. Similarly, the nozzle 10, 110, 210, 310 can have any number of condiment discharge ports 18, 118, 218, 318 preferably located at the end of the internal chamber 14, 114, 214, 314. The condiment discharge ports 18, 118, 218, 318 can each have dedicated extensions 20, 120, 220, 320 for performing the above-described diverting and shielding functions for each port 18, 118, 218, 318 or can all share the same extension 20, 120, 220, 320. Also, condiment discharge ports 18, 118, 218, 318 can each have dedicated funnel-shaped end portions 30, 130, 230, 330 each functioning substantially as described above.

We claim:

1. A condiment dispensing nozzle comprising:

a nozzle body;

a condiment input port defined in the nozzle body;

a chamber within the nozzle body and in fluid communication with the condiment input port;

a condiment discharge port defined in the nozzle body and in fluid communication with the chamber;

a flow disrupter in the chamber for disrupting condiment flow upstream of the condiment discharge port, the flow disrupter having a funnel-shaped end wall of the chamber adjacent to the discharge port for funneling condiment in the chamber to the discharge port, wherein the funnel-shaped end wall has an axis and opens into the chamber at an angle with respect to the axis, the angle being between 30 degrees and 90 degrees; and a skirt extending from a portion of the nozzle body beyond the condiment discharge port.

2. The nozzle as claimed in claim 1, wherein the angle is about 45 degrees.

3. A condiment dispensing nozzle comprising:

a nozzle body;

a condiment input port defined in the nozzle body;

a chamber within the nozzle body and in fluid communication with the condiment input port;

a condiment discharge port defined in the nozzle body and in fluid communication with the chamber;

a flow disrupter in the chamber for disrupting condiment flow upstream of the condiment discharge port, wherein the flow disrupter includes a concave end portion of the chamber joining at least one side wall of the chamber with the condiment discharge port; and a skirt extending from a portion of the nozzle body beyond the condiment discharge port.

4. A condiment dispensing nozzle comprising:

a nozzle body;

a condiment input port defined in the nozzle body;

a chamber within the nozzle body and in fluid communication with the condiment input port;

a condiment discharge port defined in the nozzle body and in fluid communication with the chamber;

a flow disrupter in the chamber for disrupting condiment flow upstream of the condiment discharge port, the flow disrupter having at least one baffle in the chamber for diverting condiment flow in the chamber, wherein the at least one baffle extends from an insert received within the chamber; and a skirt extending from a portion of the nozzle body beyond the condiment discharge port.

5. A condiment dispensing nozzle comprising:

a nozzle body;

an expansion chamber within the nozzle body, the expansion chamber being elongated in shape and having a length;

a discharge recess defined in an end of the nozzle body;

a condiment discharge port defined in the nozzle body, in fluid communication with the expansion chamber and the discharge recess, and located at an end of the expansion chamber, the discharge port defining a restriction between the expansion chamber and the discharge recess; and a flow disrupter in the expansion chamber for disrupting flow in the expansion chamber, wherein a majority of the length of the expansion chamber has a decreasing cross-sectional area toward the condiment discharge port.

6. A condiment dispensing nozzle comprising:

a nozzle body;

an expansion chamber within the nozzle body, the expansion chamber being elongated in shape and having a length;

a discharge recess defined in an end of the nozzle body;

a condiment discharge port defined in the nozzle body, in fluid communication with the expansion chamber and the discharge recess, and located at an end of the expansion chamber, the discharge port defining a restriction between the expansion chamber and the discharge recess; and a flow disrupter in the expansion chamber for disrupting flow in the expansion chamber, the flow disrupter having a funnel-shaped end of the expansion chamber in which the condiment discharge port is located, wherein the funnel-shaped end has an axis and opens into the expansion chamber at an angle with respect to the axis of between 30 degrees and 90 degrees.

7. The nozzle as claimed in claim 6, wherein the angle is about 45 degrees.

8. A condiment dispensing nozzle comprising:

a nozzle body;

an expansion chamber within the nozzle body;

a discharge recess defined in an end of the nozzle body;

a condiment discharge port defined in the nozzle body, in fluid communication with the expansion chamber and the discharge recess, and located at an end of the expansion chamber, the discharge port defining a restriction between the expansion chamber and the discharge recess; and a flow disrupter in the expansion chamber for disrupting flow in the expansion chamber, the flow disrupter including a concave portion of the expansion chamber defining at least part of the end of the expansion chamber.

9. A condiment dispensing nozzle comprising:

a nozzle body;

an expansion chamber within the nozzle body;

a discharge recess defined in an end of the nozzle body;

a condiment discharge port defined in the nozzle body and in fluid communication with the expansion chamber and the discharge recess, the discharge port defining a restriction between the expansion chamber and the discharge recess; and a flow disrupter in the expansion chamber for disrupting flow in the expansion chamber, wherein the flow disrupter includes at least one baffle in the expansion chamber for diverting condiment flow through the nozzle away from a trajectory directly toward the condiment discharge port.

10. A condiment dispensing nozzle comprising:

a nozzle body;

an expansion chamber within the nozzle body;

a discharge recess defined in an end of the nozzle body;

a condiment discharge port defined in the nozzle body and in fluid communication with the expansion chamber and the discharge recess, the discharge port defining a restriction between the expansion chamber and the discharge recess; and a flow disrupter in the expansion chamber for disrupting flow in the expansion chamber, wherein the flow disrupter includes a baffle insert received within the expansion chamber, the baffle insert having at least one baffle positioned to divert condiment flow to a circumferential path in the expansion chamber.

11. A method for dispensing flowable condiment through a nozzle, comprising:

receiving flowable condiment through an input port of the nozzle;

passing condiment into an expansion chamber in fluid communication with the input port of the nozzle to slow condiment speed;

passing condiment through the expansion chamber toward an output port;

inducing crossflow of condiment in the expansion chamber adjacent to the output port;

constricting condiment flow through the output port; and shielding against lateral condiment spray exiting the output port.

12. The method as claimed in claim 11, further comprising inducing circumferential condiment flow in the expansion chamber.

13. The method as claimed in claim 12, wherein circumferential condiment flow is induced by at least one baffle in the expansion chamber.

14. The method as claimed in claim 12, wherein circumferential condiment flow is induced by protrusions on inside walls of the expansion chamber.

15. The method as claimed in claim 11, further comprising converging condiment flow in the expansion chamber toward the output port via a funnel-shaped end wall of the expansion chamber, the output port located in the funnel-shaped end wall of the expansion chamber.

16. The method as claimed in claim 11, further comprising converging condiment flow in the expansion chamber toward the output port via a concave end wall of the expansion chamber, the output port located in the concave end wall of the expansion chamber.

17. The method as claimed in claim 11, further comprising gradually constricting condiment flow as the condiment flow passes through the expansion chamber.

18. The method as claimed in claim 11, wherein the output port has an axis and wherein at least a portion of the condiment flow exits the output port at an angle with respect to the axis.

19. The method as claimed in claim 11, wherein shielding against lateral condiment spray exiting the output port includes redirecting condiment flow via at least one wall extending from adjacent the output port.

20. A method of controlling condiment discharge from a nozzle, comprising:

passing condiment flow through an expansion chamber;

diverting condiment flow from internal walls of the expansion chamber toward an output port in fluid communication with the expansion chamber;

discharging a portion of condiment flow from the output port at an angle with respect to an axis of the output port; and diverting the portion of discharged condiment flow to a trajectory having a reduced angle with respect to the axis of the output port.

21. The method as claimed in claim 20, further including inducing vortex flow in the expansion chamber.

22. The method as claimed in claim 21, wherein vortex flow is induced in the expansion chamber via at least one protrusion extending from at least one internal wall of the expansion chamber.

23. The method as claimed in claim 21, wherein vortex flow is induced in the expansion chamber via at least one baffle in the expansion chamber.

24. The method as claimed in claim 20, wherein condiment flow is diverted from the internal walls of the expansion chamber radially toward the output port.

25. The method as claimed in claim 24, wherein condiment flow is diverted from the internal walls of the expansion chamber by a funnel-shaped end wall of the expansion chamber.

26. The method as claimed in claim 24, wherein condiment flow is diverted from the internal walls of the expansion chamber by a concave-shaped end portion of the expansion chamber.

27. The method as claimed in claim 20, wherein diverting the portion of discharged condiment flow includes blocking the portion of discharged condiment flow from a lateral trajectory out of the nozzle.

28. The method as claimed in claim 27, wherein the portion of discharged condiment flow is blocked by at least one wall extending from adjacent to the output port.

29. The method as claimed in claim 27, wherein the at least one wall is a skirt around the output port.

30. A condiment dispensing nozzle comprising:

a nozzle body;

a condiment input port defined in the nozzle body;

a chamber within the nozzle body and in fluid communication with the condiment input port;

a condiment discharge port defined in the nozzle body and in fluid communication with the chamber; and a flow disrupter in the chamber, the flow disrupter having a plurality of flow barriers positioned in the chamber to disrupt condiment flow upstream of the condiment discharge port, wherein each barrier has at least one aperture defined therein through which condiment can flow.

31. The nozzle as claimed in claim 30, wherein at least two of the apertures are misaligned with respect to one another to force condiment flow to turn within the chamber.

32. A method for controlling condiment flow in a nozzle, the method comprising:

passing condiment flow into an expansion chamber defined in the nozzle;

passing the condiment flow past a flow disrupter in the nozzle;

disrupting the condiment flow in the nozzle responsive to passing condiment flow past the flow disrupter; and discharging the condiment flow from an output port of the nozzle, wherein passing the condiment flow past a flow disrupter includes passing the condiment flow past barriers extending into the condiment flow in the nozzle and passing the condiment flow through misaligned apertures in order to cause the condiment flow to turn within the nozzle.

33. A method for controlling condiment flow in a nozzle, the method comprising:

passing condiment flow into an expansion chamber defined in the nozzle;

passing the condiment flow past a flow disrupter in the nozzle;

disrupting the condiment flow in the nozzle responsive to passing condiment flow past the flow disrupter; and discharging the condiment flow from an output port of the nozzle, wherein passing the condiment flow past a flow disrupter includes diverting condiment flow from interior walls of the nozzle to generate crossflow in the nozzle upstream of the output port.

34. A method for controlling condiment flow in a nozzle having an axis, the method comprising:

passing condiment flow into a chamber in the nozzle;

diverting the condiment flow around the axis in a first direction; and diverting the condiment flow around the axis in an opposite direction to disrupt the condiment flow through the nozzle.

35. The method of claim 34, wherein the steps of diverting condiment flow includes disrupting condiment flow with at least one flow barrier.

36. The method of claim 35, further comprising passing condiment flow through at least one aperture in the nozzle defined by the at least one flow barrier.

37. The method of claim 34, further comprising inserting an insert within the chamber in the nozzle, wherein the condiment flow is diverted by the insert within the chamber.

* * * * *